US008507818B2

(12) United States Patent
Kwak

(10) Patent No.: US 8,507,818 B2
(45) Date of Patent: Aug. 13, 2013

(54) PUSH SWITCH DEVICE

(75) Inventor: Young-Kap Kwak, Seoul (KR)

(73) Assignee: Magma Co., Ltd., Gimpo-Si, Gyeonggi-Do (KR)

( * ) Notice: Subject to any disclaimer, the term of this patent is extended or adjusted under 35 U.S.C. 154(b) by 342 days.

(21) Appl. No.: 13/044,796

(22) Filed: Mar. 10, 2011

(65) Prior Publication Data

US 2012/0228099 A1 Sep. 13, 2012

(51) Int. Cl.
*H01H 5/30* (2006.01)
*H01H 13/48* (2006.01)

(52) U.S. Cl.
USPC ..... 200/406; 200/520; 200/529

(58) Field of Classification Search
USPC ..... 200/406, 516, 523, 526, 528, 529, 200/533, 538, 542, 551, 566, 568, 569, 573, 200/574, 329, 341
See application file for complete search history.

(56) References Cited

U.S. PATENT DOCUMENTS 6,018,132 A * 1/2000 Chen ..... 200/406
6,114,644 A * 9/2000 Nishikawa ..... 200/406
7,449,654 B2 * 11/2008 Tsuduki ..... 200/406
7,564,003 B2 * 7/2009 Hu et al. ..... 200/406
2005/0029084 A1 * 2/2005 Watanabe et al. ..... 200/406
2006/0185971 A1 * 8/2006 Rochon ..... 200/406
2008/0237020 A1 * 10/2008 Hu et al. ..... 200/516

FOREIGN PATENT DOCUMENTS

KR 10-755223 B1 9/2007

* cited by examiner

*Primary Examiner* — Michael Friedhofer
(74) *Attorney, Agent, or Firm* — Kile Park Reed & Houtteman PLLC

(57) ABSTRACT

Disclosed is a push switch device. Since a push button is pressed to relatively rotate first and second pressing members in opposite directions and a push direction conversion unit converts the relative rotation of the first and second pressing members into a push movement in a switching direction, a pressing projection of the first pressing member can accurately vertically press an apex of a movable terminal. Therefore, a sense of click when the movable terminal is resiliently deformed and recovered can be maintained well, and a slide friction generated between the movable terminal and the pressing projection of the first pressing member can be minimized, preventing decrease in sense of operation and reduction in lifespan of parts due to the friction. In addition, an operation sense of the push button can be improved because straightness of the push button can be improved and there is no additional repulsion, except the repulsion by the resilient deformation of the movable terminal.

6 Claims, 9 Drawing Sheets

PUSH SWITCH DEVICE

BACKGROUND

1. Field of the Invention

The present invention relates to a push switch device, and more particularly, to a push switch device capable of reducing a longitudinal size to form a thin device by disposing a push button for a switch operation in a push direction perpendicular to a switching direction in which an apex of a dome-shaped movable terminal is pressed downward.

2. Discussion of Related Art

In general, a push switch device, widely used in a mobile phone, a game console, various audio devices, and so on, includes a housing formed of an insulating resin, etc., a dome-shaped movable terminal and a plurality of fixed terminals installed in the housing, and a push button projecting from the housing to operate the movable terminal. Accordingly, when the push button is pushed to press an apex of the movable terminal, the apex is resiliently deformed downward and recovered to electrically connect or open the plurality of fixed terminals, performing a switch function.

Such a push switch device is disposed such that a push direction of the push button is perpendicular to a direction in which the apex of the movable terminal is pressed to be resiliently deformed downward, i.e., a switching direction, reducing a longitudinal size to form a thin device.

For example, Korean Patent Registration No. 10-755223 discloses, as shown in FIG. 8, a configuration that a switching direction in which an apex of a dome-shaped movable terminal 130 is pressed to be resiliently deformed downward is perpendicular to a push direction of a push button 110.

However, when the push button 110 of the push switch device is pushed, a push part 111 formed at an end of the push button 110 orthogonally moves downward by a sloped plate 140 to press the apex of the dome-shaped movable terminal 130. Accordingly, a sense of click generated when the movable terminal is resiliently deformed is decreased in comparison with a conventional method in which a push direction of the push button is disposed in parallel to a switching direction of the movable terminal. In addition, as the push part 111 is lowered, a connection part 112 is bent downward. As a result, straightness of the push button 110 is deteriorated, and the connection part 112 is bent to increase a user's push force needed to push the push button 110, remarkably decreasing operation performance of the push button 110.

Further, since a contact point of the movable terminal 130 with the push part 111 of the push button 110 moves between a position deviated from the apex of the movable terminal 130 and the apex, friction due to slide friction is generated according to the moving distance. The friction generated during the switch operation may decrease functionality and operation performance of the push switch device and reduce lifespan of parts.

SUMMARY OF THE INVENTION

In order to solve the problems, the present invention is directed to a push switch device, in which a push direction of a push button is disposed perpendicular to a switching direction of a dome-shaped movable terminal, capable of improving a sense of click upon a switch operation due to precise application of a push force of the push button to an apex of the movable terminal in a vertical downward direction, and minimizing friction between the movable terminal and a push member configured to press the movable terminal.

The present invention is also directed to a push switch device capable of improving straightness of the push button, minimizing additionally generated repulsion in addition to repulsion due to resilient deformation of the movable terminal, and improving operation performance of the push button.

According to an aspect of the present invention, there is provided a push switch device including a housing, first and second terminals having connection pieces disposed on a bottom surface in the housing, and a dome-shaped movable terminal installed in the housing and having an apex pressed to be resiliently deformed and recovered to electrically connect or open the connection pieces of the first and second terminals, which comprises: a first pressing member having a pressing projection disposed over the movable terminal to contact the apex of the movable terminal and installed in the housing to press the apex of the movable terminal downward to resiliently deform the movable terminal and be rotated about a switching direction; a second pressing member installed in the housing to overlap the first pressing member to be rotated about the same rotational center axis as the first pressing member; a push button passing through one sidewall of the housing to be partially exposed to the exterior and moving straightly in a push direction perpendicular to the switching direction of the movable terminal to relatively rotate the first and second pressing members in opposite directions; and a push direction conversion unit installed at the first and second pressing members and converting the relative rotation of the first and second pressing members into a push movement in the switching direction in which the pressing projection of the first pressing member presses the apex of the movable terminal downward.

According to another aspect of the present invention, there is provided a push switch device including a housing, and a dome-shaped movable terminal installed in the housing and having an apex pressed to be resiliently deformed and recovered to electrically connect or open connection pieces of first and second terminals, which comprises: a first pressing member having a pressing projection disposed over the movable terminal to contact the apex of the movable terminal and installed in the housing to press the apex of the movable terminal downward to resiliently deform the movable terminal and be rotated about a switching direction; a second pressing member installed in the housing to overlap the first pressing member; a push button passing through one sidewall of the housing to be partially exposed to the exterior and moving straightly in a push direction perpendicular to the switching direction of the movable terminal to rotate the first pressing member; and a push direction conversion unit installed at the first and second pressing members and converting the rotation of the first pressing member into a push movement in the switching direction in which the pressing projection of the first pressing member presses the apex of the movable terminal downward.

Here, the push direction conversion unit comprises a plurality of sloped projections formed on an upper surface of the first pressing member and disposed about a rotational center axis of the first pressing member in a circumferential direction thereof; and a plurality of sloped grooves formed on a lower surface of the second pressing member to correspond to the plurality of sloped projections such that the plurality of sloped projections are inserted into the plurality of sloped grooves.

In addition, a support shaft projects from a rotational center of the upper surface of the first pressing member, and a support hole is formed in a rotational center of the lower surface of the second pressing member such that the support shaft is inserted into the support hole.

Further, the relative rotation configuration of the first and second pressing members in opposite directions by the push button comprises a plurality of rotary projections projecting from outer circumferences of the first and second pressing members and disposed at 180° intervals, and a push bar bifurcated from the push button and having ends disposed adjacent to the pair of rotary projections to push the first and second rotary projections when the push button moves in the push direction, relatively rotating the first and second pressing members in opposite directions.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, exemplary embodiments of the present invention will be described in detail below with reference to the accompanying drawings.

Figure 1:
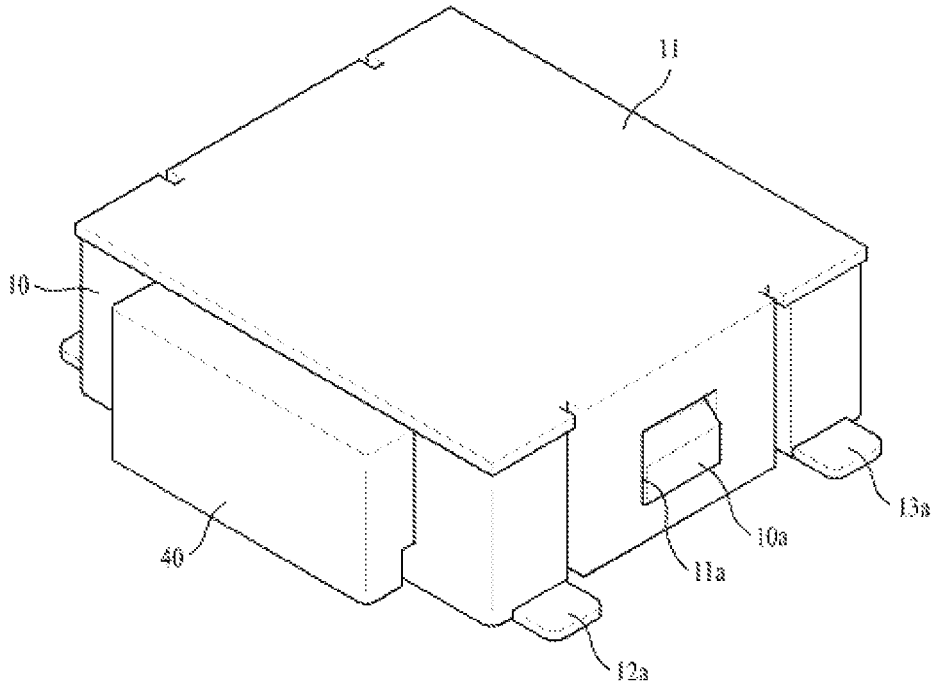
FIG. 1 is a perspective view of a push switch device in accordance with an exemplary embodiment of the present invention.
Figure 2:
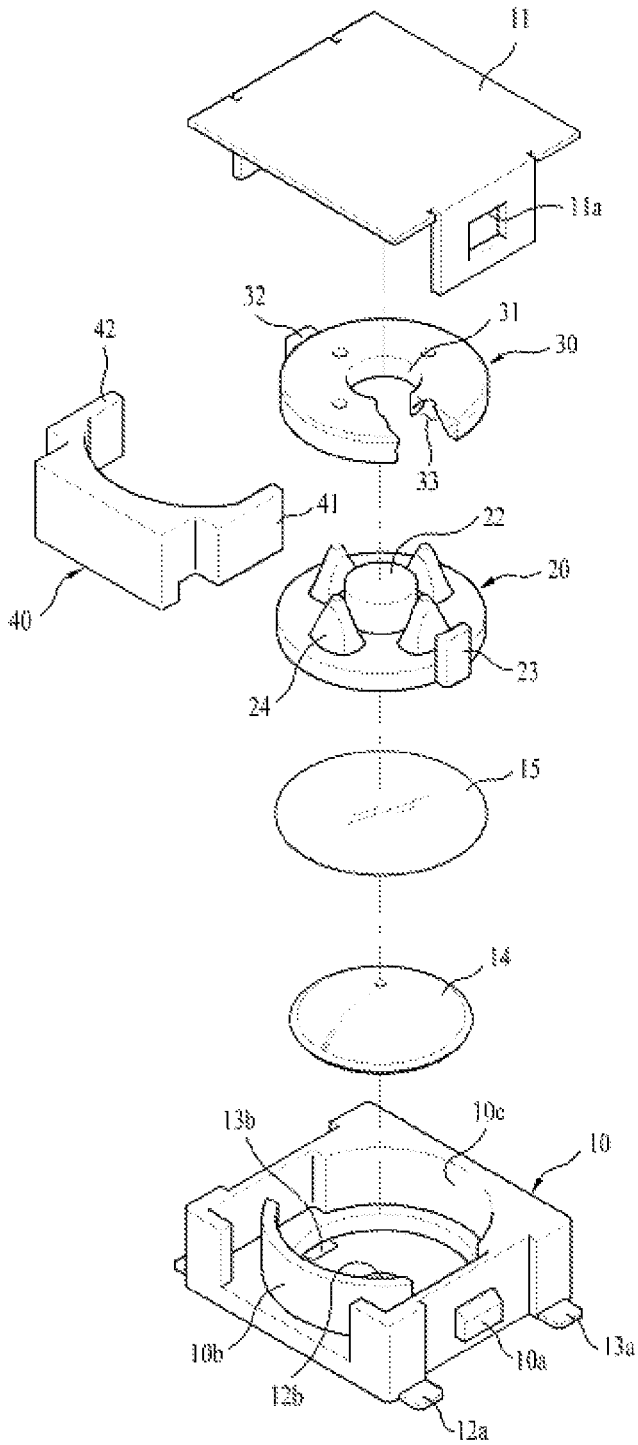
FIG. 2 is an exploded perspective view of the push switch device in accordance with the exemplary embodiment of the present invention.

FIGS. 1 and 2 are a perspective view and an exploded perspective view showing a push switch device in accordance with an exemplary embodiment of the present invention. The push switch device of the present invention includes a parallelepiped shaped housing 10 having an internal space. The housing 10 is formed by injection-molding an insulating resin, and configured such that an upper part thereof is opened to install parts in the housing 10 and the upper part is covered by a cover 11 after installation of the parts.

The housing 10 and the cover 11 have a coupling structure in which coupling projections 10*a* are formed at both sidewalls of the housing 10 and coupling holes 11*a* are formed at the cover 11 such that the coupling projections 10*a* are inserted into the coupling holes 11*a* to be hooked by the coupling holes 11*a*.

The housing 10 includes first and second fixed terminals 12 and 13 configured to perform a switch function, and a movable terminal 14 configured to connect or open the first and second fixed terminals 12 and 13.

Figure 4:
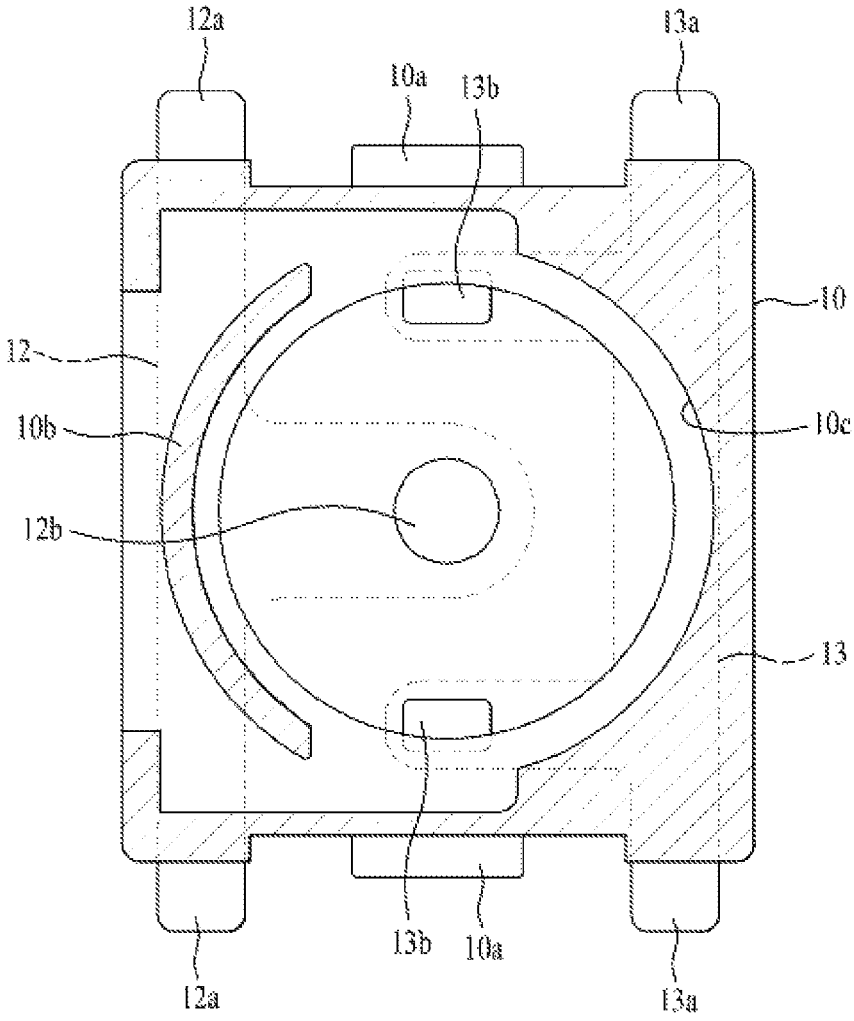
FIG. 4 is a horizontal cross-sectional view showing an installation state of first and second fixed terminals of the push switch device in accordance with the exemplary embodiment of the present invention.

As shown in FIGS. 2 and 4, the first and second fixed terminals 12 and 13 are formed of a conductive metal, and molded by injection molding of the housing 10, and buried in the housing 10. The first and second fixed terminals 12 and 13 includes external terminals 12*a* and 13*a* exposed to lower parts of both sidewalls of the housing 10 to be electrically connected to the exterior, and connection pieces 12*b* and 13*b* exposed to a bottom surface in the housing 10 to be connected to the movable terminal 14, respectively. Here, the connection piece 12*b* of the first fixed terminal 12 is disposed at a center of the bottom surface of the housing 10, and the connection pieces 13*b* of the second fixed terminal 13 is disposed at both side edges of the bottom surface of the housing 10.

Figure 3A:
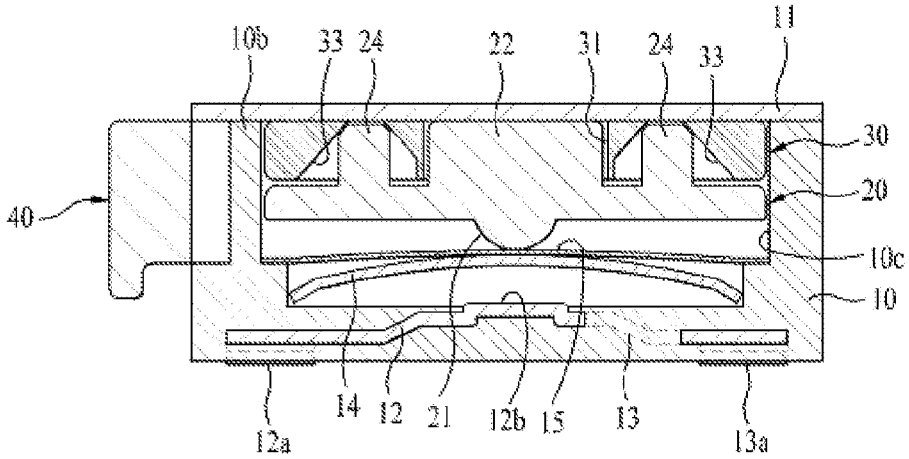
FIGS. 3A and 3B are vertical cross-sectional views showing operation states of the push switch device in accordance with the exemplary embodiment of the present invention.
Figure 3B:
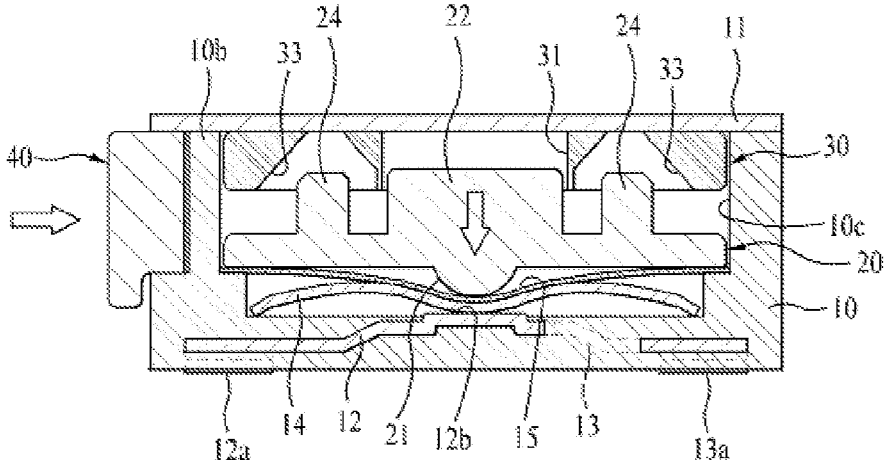

As shown in FIGS. 2 and 3A, the movable terminal 14 is formed of stainless steel having good conductivity and resiliency, has a dome shape, and is installed on the bottom surface of the housing 10. An apex of the movable terminal 14, which is convex upward, is disposed on the connection piece 12*b* of the first fixed terminal 12, and an edge of the movable terminal 14 is installed to contact the connection piece 13*b* of the second fixed terminal 13. Accordingly, when the apex of the movable terminal 14 is pressed to be resiliently deformed downward, as shown in FIG. 3B, the apex of the movable terminal 14 contacts the connection piece 12*b* of the first fixed terminal 12 to electrically connect the first and second fixed terminals 12 and 13, and when the pressure is removed, as shown in FIG. 3A, the apex of the movable terminal 14 is resiliently returned to its original position to electrically open the first and second fixed terminals 12 and 13.

A structure configured to press the apex of the movable terminal 14 includes first and second pressing members 20 and 30 installed to vertically overlap over the movable terminal 14 in the housing 10, and a push button 40 installed to pass through one sidewall of the housing 10. The structure is formed of an insulating resin material.

The first pressing member 20 installed just over the movable terminal 14 has a circular disk shape, includes a pressing projection 21 formed at the bottom surface thereof and in contact with the apex of the movable terminal, and is installed in the housing 10 to rotate about a switching direction in which the pressing projection 21 vertically presses the apex of the movable terminal 14 downward to resiliently deform the movable terminal 14.

The second pressing member 30 overlapped on the first pressing member 20 also has a circular disk shape, and installed in the housing to rotate about the same central axis as the first pressing member 20.

Figure 5A:
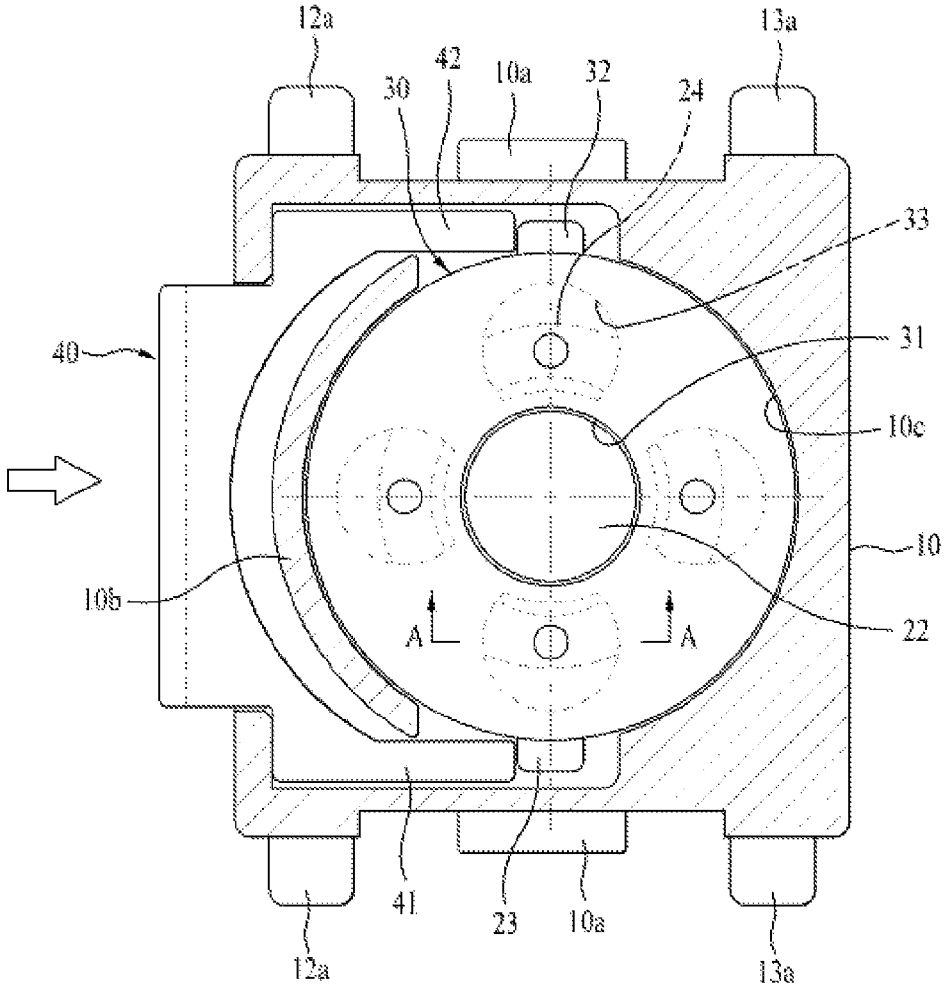
FIGS. 5A and 5B are horizontal cross-sectional views showing operation states of the push switch device in accordance with the exemplary embodiment of the present invention.

As shown in FIGS. 2 and 5A, the housing 10 may have an arc-shaped wall 10*b* formed at a portion of the housing 10 at which the push button 40 is installed to rotatably support the first and second pressing members 20 and 30 to correspond to outer surfaces of the first and second pressing members 20 and 30, and an arc-shaped surface 10*c* formed at one sidewall opposite to the arc-shaped wall 10*b*.

In addition, a support shaft 22 projects from a rotational center of an upper surface of the first pressing member 20, and a support hole 31 is formed in a rotational center of the second pressing member 30 such that the support shaft 22 is inserted into the support hole 31. Accordingly, the first and second pressing members 20 and 30 are rotatably supported by each other, and the first pressing member 20 is straightly supported in an axial direction of the support hole 31 and the support shaft 22 with respect to the second pressing member 30, i.e., a switching direction.

Meanwhile, the push button 40 is disposed to pass through one sidewall of the housing 10 to be partially exposed to the exterior, cross the push direction with respect to the switching direction, and relatively rotate the first and second pressing members 20 and 30 in opposite directions.

Figure 5B:
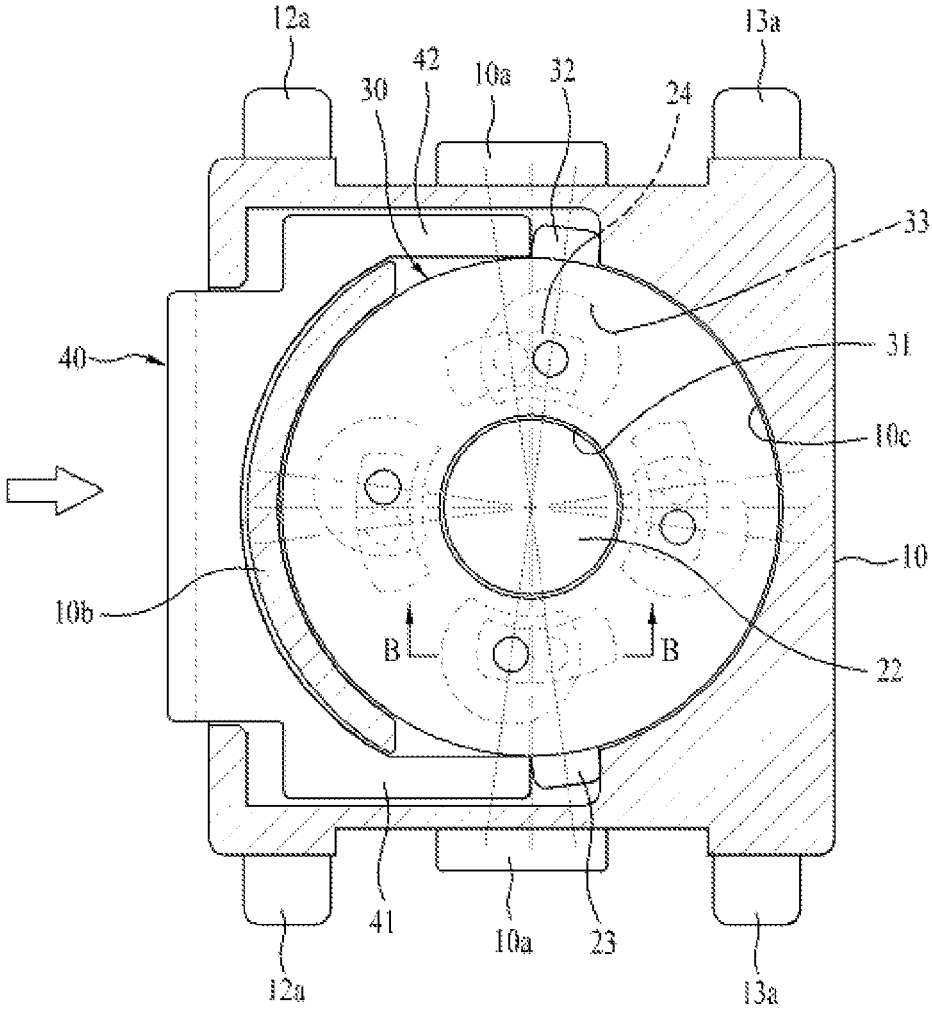

As shown in FIGS. 2 and 5A, a relative rotation mechanism of the first and second pressing members 20 and 30 by the push operation of the push button 40 includes a pair of rotary projections 23 and 32 projecting from outer circumferences of the first and second pressing members 20 and 30 and disposed at 180° intervals, and push bars 41 and 42 bifurcated from the push button 40 and having ends disposed adjacent to the pair of rotary projections 23 and 32, respectively. Accordingly, when the push button 40 is pushed as shown in FIG. 5B, since both of the push bars 41 and 42 simultaneously push the rotary projections 23 and 32 of the first and second pressing members 20 and 30, the first and second pressing members 20 and 30 are relatively rotated to a predetermined angle in opposite directions.

In addition, the relative rotation mechanism of the first and second pressing members 20 and 30 by the push operation of the push button 40 is not limited to the mechanism in which the first and second pressing members 20 and 30 are relatively rotated in opposite directions, but may include a mechanism in which only one of the first and second pressing members 20 and 30 is rotated.

Figure 6A:
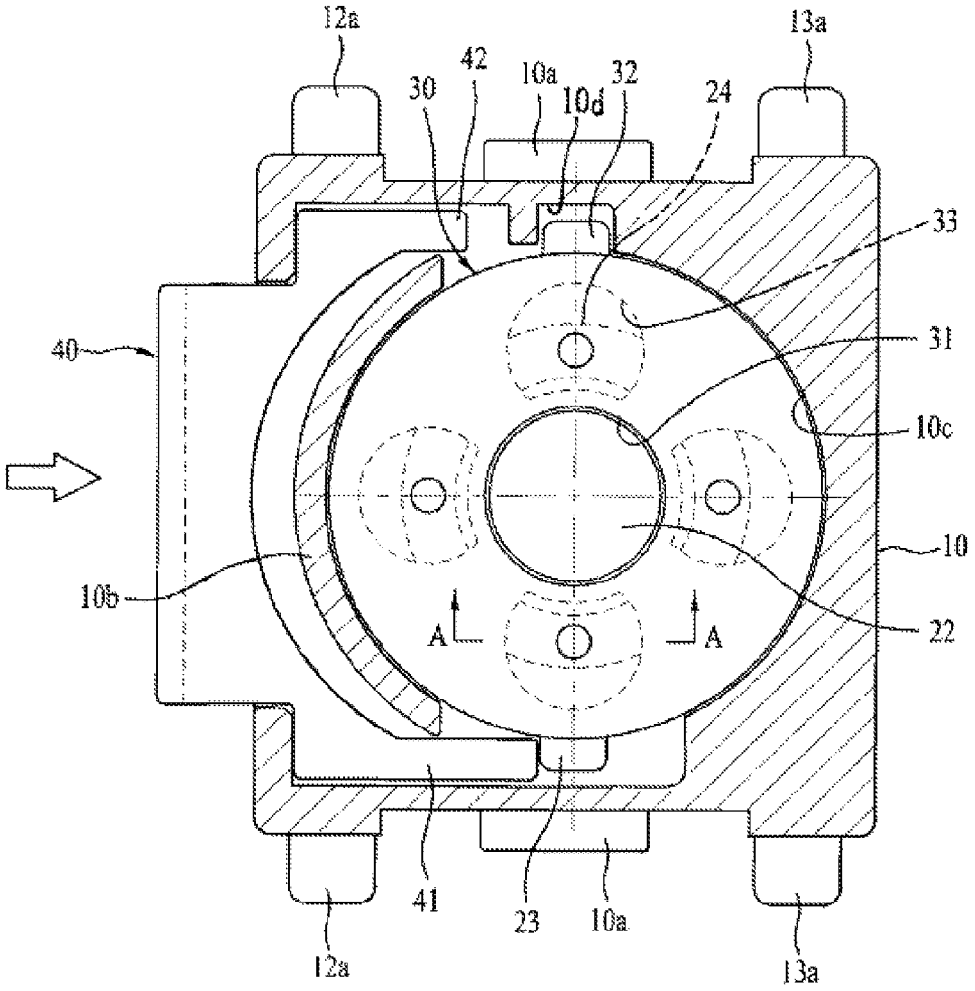
FIGS. 6A and 6B are horizontal cross-sectional views showing another embodiment of the push switch device in accordance with the exemplary embodiment of the present invention.
Figure 6B:
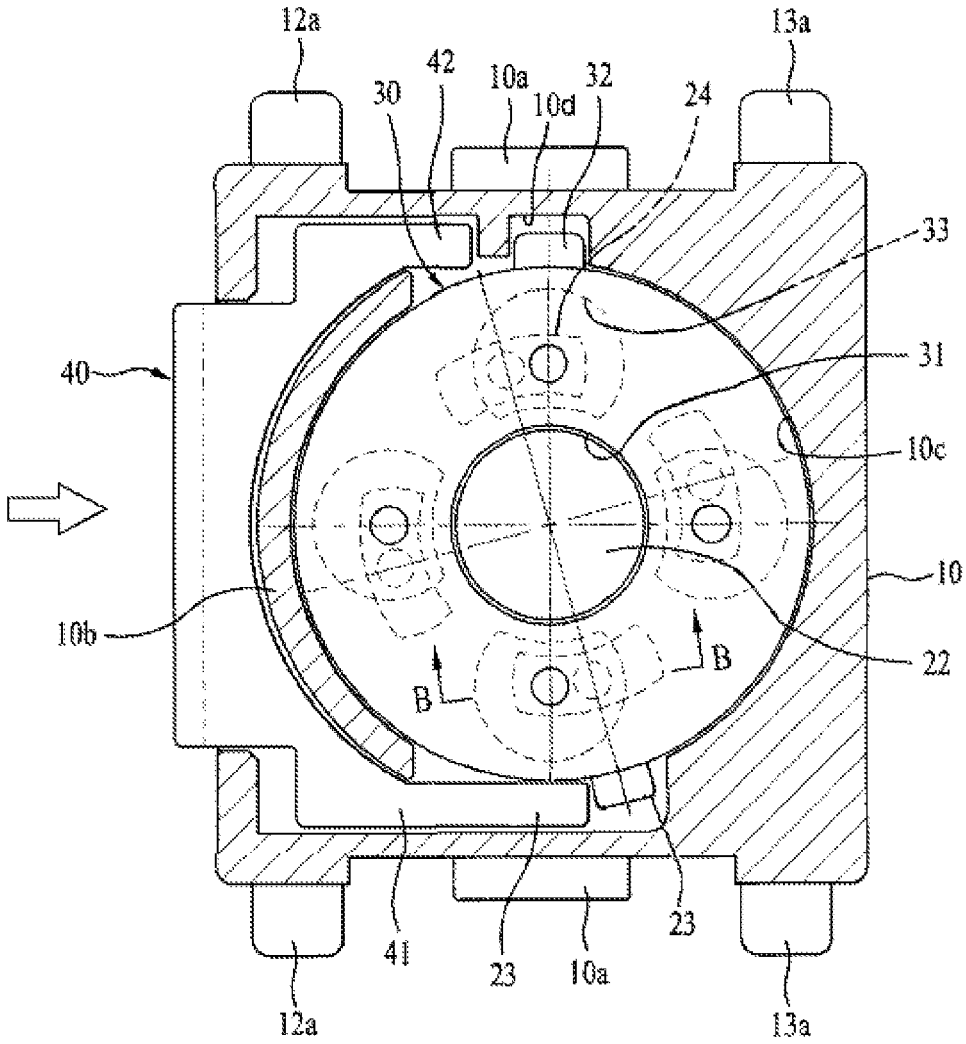

For example, FIGS. 6A and 6B show a configuration in which only the first pressing member 20 is rotated by the push operation of the push button 40. That is, in the push bars 41 and 42 of the push button 40, the push bar 42 adjacent to the second pressing member 30 has a short length such that the push bar 42 does not arrive at the rotary projection 32 of the second pressing member 30 even when the push button 40 is pushed, and the rotary projection 32 of the second pressing member 30 is inserted into a fixed groove 10*d* formed in an inner wall of the housing 10 to prevent rotation of the second pressing member 30, accomplishing the configuration.

In addition, while not shown in drawings, by applying the above-mentioned configuration in a contrary manner, a configuration in which only the second pressing member 30 is rotated while the first pressing member 20 is not rotated may be provided.

Here, the configuration in which only one of the first and second pressing members 20 and 30 is rotated can obtain the same relative rotation angle as long as a moving distance of the push button 40 in the push direction is set two times larger than that of the configuration in which the first and second pressing members 20 and 30 are relatively rotated in opposite directions.

Returning to FIGS. 2, 3A and 5A, the first and second pressing members 20 and 30 include a push direction conversion unit configured to convert a relative rotation of the first and second pressing members 20 and 30 into a pressing movement of the first pressing member 20 in the switching direction.

The push direction conversion unit includes a plurality of sloped projections 24 projecting from the upper surface of the first pressing member 20 and disposed around a rotational central axis of the first pressing member 20 in a circumferential direction, and a plurality of sloped grooves 33 formed in a lower surface of the second pressing member 30 and having a shape corresponding to the plurality of sloped projections 24 such that the sloped projections 24 are inserted into the sloped grooves 33. Four sloped projections 24 and four sloped grooves 33 may be provided at 90° intervals.

Figure 7A:
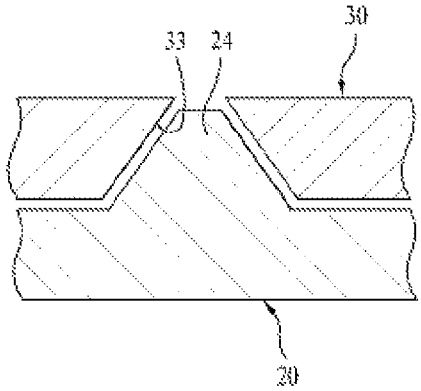
FIG. 7A is a cross-sectional view taken along line A-A of FIG. 6A.
Figure 7B:
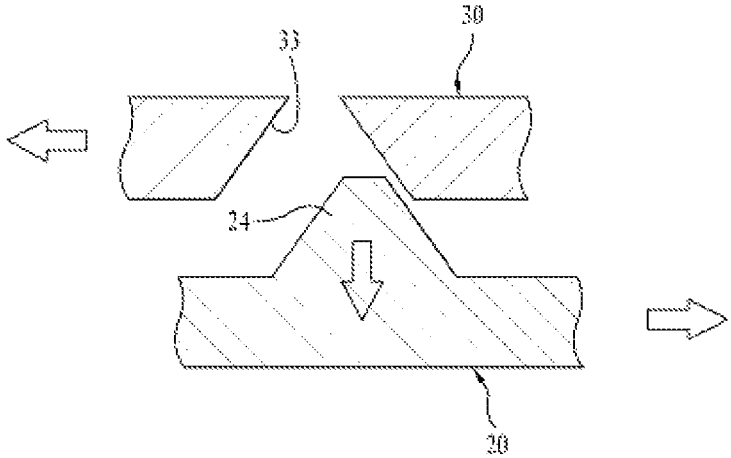
FIG. 7B is a cross-sectional view taken along line B-B of FIG. 6B.
Figure 8:
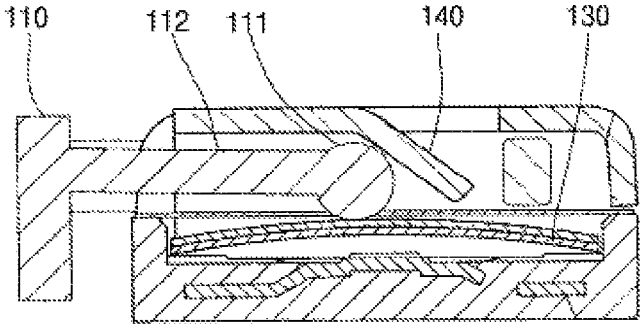
FIG. 8 is a cross-sectional view showing a conventional push switch device.

Therefore, as shown in FIGS. 5A and 7A, in a state in which the sloped projections 24 of the first pressing member 20 are inserted into the sloped grooves 33 of the second pressing member 30, when the first and second pressing members 20 and 30 are relatively rotated in opposite directions such that the sloped projections 24 and the sloped grooves 33 are dislocated as shown in FIGS. 5B and 7B, the first pressing member 20 moves in the switching direction with respect to the second pressing member 30, i.e., a direction perpendicular to the push direction of the push button 40. Accordingly, as shown in FIG. 3B, the pressing projection 21 of the first pressing member 20 accurately presses the apex of the movable terminal 14 to resiliently deform the movable terminal 14 downward.

Here, the sloped projections 24 of the first pressing member 20 have a shape in which both sides surfaces of a frusto-conical shape are partially cut in a circumferential direction of the first pressing member 20. Accordingly, a contact surface of the first and second pressing members 20 and 30 can be reduced to perform a smoother relative rotation in an opposite direction. In addition, the sloped grooves 33 of the second pressing member 30 may have a shape in which an inner side surface of a frusto-conical shape is partially cut in a circumferential direction of the second pressing member 30, such that the second pressing member 30 can be designed to have a smaller outer diameter.

In addition, as shown in FIG. 3A, the movable terminal 14 installed in the housing 10 is covered and protected by a thin protective sheet 15 to prevent a negative influence on the movable terminal 14 due to moisture.

Hereinafter, an operation of the present invention constituted as above will be described.

When the push button 40 is pushed in a state as shown in FIGS. 3A and 5A, the push bars 41 and 42 of the push button 40 move straightly in the push direction to push the rotary projections 23 and 32 of the first and second pressing members 20 and 30, respectively, such that the first and second pressing members 20 and 30 are relatively rotated about the switching direction perpendicular to the push direction of the push button 40 to a predetermined angle in opposite directions.

When the first and second pressing members 20 and 30 are relatively rotated in opposite directions, as shown in FIGS. 5B and 7B, the sloped projections 24 of the first pressing member 20 and the sloped grooves 33 of the second pressing member 30 are dislocated such that the first pressing member 20 moves straightly in the switching direction with respect to the second pressing member 30. Accordingly, as shown in FIG. 3B, since the pressing projection 21 of the first pressing member 20 vertically presses the apex of the dome-shaped movable terminal 14 to resiliently deform the movable terminal 14 downward, the apex of the movable terminal 14 contacts the connection piece 12*b* of the first fixed terminal 12, and the first fixed end 12 is electrically connected to the second fixed terminal 13.

Continuously, when the push force of the push button 40 is removed, since the apex recovers by a resilient recovering force of the movable terminal 14 as shown in FIG. 3A and is moved apart from the connection piece 12*b* of the first fixed terminal 12, the first fixed terminal 12 and the second fixed terminal 13 are electrically opened again. Simultaneously, since the first pressing member 20 is raised again by the resilient recovering force of the movable terminal 14 and the sloped projections 24 are aligned with the sloped grooves 33 of the second pressing member 30 as shown in FIGS. 5A and 7A, the first and second pressing members 20 and 30 and the push button 40 are recovered to a state before the push.

When the push button 40 of the present invention is pushed once, the apex of the movable terminal 14 is resiliently deformed and recovered to electrically connect and open the first and second fixed terminals 12 and 13 to perform the switching function, and the push direction of the push button 40 is disposed perpendicular to the switching direction in which the apex of the movable terminal 14 is resiliently deformed downward, reducing a longitudinal size of the switch device to reduce the thickness of the switch device.

In particular, as the pressing projection 21 of the first pressing member 20 accurately vertically presses the apex of the movable terminal 14 by the push operation of the push button 40, a sense of click can be improved. In addition, in comparison with the conventional configuration in which the apex of the movable terminal 14 is orthogonally pressed, slide friction between the movable terminal 14 and the pressing projection 21 of the first pressing member 20 can be minimized to prevent a decrease in the sense of operation and reduction in lifespan of parts due to the friction.

Further, since the rotation of the first and second pressing members 20 and 30 is converted into the straight movement in the switching direction by the push operation of the push button 40 to resiliently deform the apex of the movable terminal 14, there is no additional repulsion, except the repulsion by the resilient deformation of the movable terminal 14. Accordingly, straightness of the push button 40 can be improved, and the push force of the push button 40 can be reduced to improve an operation sense of the switch.

Furthermore, the configuration of the present invention in which the first and second pressing members 20 and 30 are simultaneously relatively rotated in opposite directions can reduce a relative rotational angle to ½ in comparison with the configuration in which any one of the first and second pressing members 20 and 30 is rotated, and thus, the moving distance of the push button 40 in the push direction can be reduced to ½ to further improve the operation performance of the push button 40.

As can be seen from the foregoing, since the push button is pressed to relatively rotate the first and second pressing members in opposite directions and the push direction conversion unit converts the relative rotation of the first and second pressing members into the push movement in the switching direction, the pressing projection of the first pressing member can accurately vertically press the apex of the movable terminal.

Therefore, similar to the configuration in which the switching direction of the movable terminal is equal to the push direction of the push button, a sense of click when the movable terminal is resiliently deformed and recovered can be maintained well, and the slide friction generated between the movable terminal and the pressing projection of the first pressing member can be minimized, preventing a decrease in the sense of operation and reduction in lifespan of parts due to the friction. In addition, and an operation sense of the push button can be improved because straightness of the push button can be improved and there is no additional repulsion, except the repulsion by the resilient deformation of the movable terminal.

In addition, the configuration of the present invention in which the first and second pressing members are relatively rotated in opposite directions can reduce a relative rotational angle to ½ in comparison with the configuration in which any one of the first and second pressing members is rotated. Accordingly, the moving distance of the push button in the push direction can be reduced to ½ to further improve the operation performance of the push button.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A push switch device including a housing, first and second terminals having connection pieces disposed on a bottom surface in the housing, and a dome-shaped movable terminal installed in the housing and having an apex pressed to be resiliently deformed and recovered to electrically connect or open the connection pieces of the first and second terminals, which comprises:

a first pressing member having a pressing projection disposed over the movable terminal to contact the apex of the movable terminal and installed in the housing to press the apex of the movable terminal downward to resiliently deform the movable terminal and be rotated about a switching direction;

a second pressing member installed in the housing to overlap the first pressing member to be rotated about the same rotational center axis as the first pressing member;

a push button passing through one sidewall of the housing to be partially exposed to the exterior and moving straightly in a push direction perpendicular to the switching direction of the movable terminal to relatively rotate the first and second pressing members in opposite directions; and a push direction conversion unit installed at the first and second pressing members and converting the relative rotation of the first and second pressing members into a push movement in the switching direction in which the pressing projection of the first pressing member presses the apex of the movable terminal downward.

2. The push switch device according to claim 1, wherein the push direction conversion unit comprises a plurality of sloped projections formed on an upper surface of the first pressing member and disposed about a rotational center axis of the first pressing member in a circumferential direction thereof; and a plurality of sloped grooves formed on a lower surface of the second pressing member to correspond to the plurality of sloped projections such that the plurality of sloped projections are inserted into the plurality of sloped grooves.

3. The push switch device according to claim 2, wherein a support shaft projects from a rotational center of the upper surface of the first pressing member, and a support hole is formed in a rotational center of the lower surface of the second pressing member such that the support shaft is inserted into the support hole.

4. The push switch device according to claim 1, wherein the relative rotation configuration of the first and second pressing members in opposite directions by the push button comprises a plurality of rotary projections projecting from outer circumferences of the first and second pressing members and disposed at 180° intervals, and a push bar bifurcated from the push button and having ends disposed adjacent to the pair of rotary projections to push the first and second rotary projections when the push button moves in the push direction, relatively rotating the first and second pressing members in opposite directions.

5. A push switch device including a housing, and a dome-shaped movable terminal installed in the housing and having an apex pressed to be resiliently deformed and recovered to electrically connect or open connection pieces of first and second terminals, which comprises:

a first pressing member having a pressing projection disposed over the movable terminal to contact the apex of the movable terminal and installed in the housing to press the apex of the movable terminal downward to resiliently deform the movable terminal and be rotated about a switching direction;

a second pressing member installed in the housing to overlap the first pressing member;

a push button passing through one sidewall of the housing to be partially exposed to the exterior and moving straightly in a push direction perpendicular to the switching direction of the movable terminal to rotate the first pressing member; and a push direction conversion unit installed at the first and second pressing members and converting the rotation of the first pressing member into a push movement in the switching direction in which the pressing projection of the first pressing member presses the apex of the movable terminal downward.

6. The push switch device according to claim 5, wherein the push direction conversion unit comprises a plurality of sloped projections formed on an upper surface of the first pressing member and disposed about a rotational center axis of the first pressing member in a circumferential direction thereof; and a plurality of sloped grooves formed on a lower surface of the second pressing member to correspond to the plurality of sloped projections such that the plurality of sloped projections are inserted into the plurality of sloped grooves.

* * * * *